US006994445B1

(12) United States Patent
Pomes

(10) Patent No.: US 6,994,445 B1
(45) Date of Patent: Feb. 7, 2006

(54) CAP WITH UNDERSIDE LIGHT

(76) Inventor: Nick J. Pomes, 501 Carmenere Dr., Kenner, LA (US) 70065

( * ) Notice: Subject to any disclaimer, the term of this patent is extended or adjusted under 35 U.S.C. 154(b) by 70 days.

(21) Appl. No.: 10/655,628

(22) Filed: Sep. 3, 2003

Related U.S. Application Data

(60) Provisional application No. 60/423,305, filed on Nov. 1, 2002, provisional application No. 60/408,049, filed on Sep. 4, 2002.

(51) Int. Cl.
*F21V 121/06* (2006.01)

(52) U.S. Cl. ..... 362/106; 362/191; 2/209.13

(58) Field of Classification Search ..... 362/103, 362/105, 106, 190, 191, 253, 234, 24; 2/209.13
See application file for complete search history.

(56) References Cited

U.S. PATENT DOCUMENTS

| | | | | |
|---|---|---|---|---|
| 4,827,384 | A | 5/1989 | Von Schlemmer | |
| 4,991,068 | A | 2/1991 | Mickey | |
| 5,510,961 | A * | 4/1996 | Peng | 362/106 |
| 5,541,816 | A | 7/1996 | Miserendino | |
| 5,667,292 | A | 9/1997 | Sabalvaro, Jr. | |
| D387,184 | S | 12/1997 | Seidmeyer et al. | |
| 5,741,060 | A | 4/1998 | Johnson | |
| 5,911,494 | A | 6/1999 | Lary | |
| 6,056,413 | A * | 5/2000 | Urso | 362/106 |
| 6,250,769 | B1 | 6/2001 | Kirk | |
| 6,398,383 | B1 | 6/2002 | Huang | |
| 6,659,618 | B2 * | 12/2003 | Waters | 362/106 |
| 6,721,962 | B1 * | 4/2004 | Polaire | 2/209.13 |
| 6,733,150 | B1 * | 5/2004 | Hanley | 362/106 |
| 2003/0231489 | A1 * | 12/2003 | Hsiao | 362/106 |

* cited by examiner

*Primary Examiner*—Laura K. Tso
(74) *Attorney, Agent, or Firm*—Garvey, Smith, Nehrbass & Doody, L.L.C.; Brett A. North

(57) ABSTRACT

A combination baseball or visor style cap and light assembly wherein in one embodiment the light assembly can be at least partially recessed in the underside of the bill so that the cap appears substantially unaltered in its aesthetic appearance. In one embodiment the light source can be a high intensity LED similar to those used in miniature flashlights and can be furnished in 3 mm or 5 mm size designations (however, any commercially available light source may be used).

146 Claims, 8 Drawing Sheets

CAP WITH UNDERSIDE LIGHT

CROSS-REFERENCE TO RELATED APPLICATIONS

Priority is hereby claimed to U.S. provisional patent application No. 60/423,305, filed Nov. 1, 2002.

Priority is hereby claimed to U.S. provisional patent application No. 60/408,049, filed Sep. 4, 2002.

U.S. provisional patent application No. 60/423,305, filed Nov. 1, 2002, is incorporated herein by reference.

U.S. provisional patent application No. 60/408,049, filed Sep. 4, 2002, is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND

1. Field

This invention relates to lamps or lights mounted to caps. In one embodiment, this device relates to lamps or lights mounted to baseball type or visor type caps.

2. General Background

Prior art lights typically function by utilizing a bulky flashlight type apparatus that attach to cap bills with clips or are installed on the frontal crown areas, similar to a miner's beacon. There is also a style in which the apparatus is attached to the underside of a bill using a metal plate screwed into the bill. In these configurations the lighting apparatuses are mostly exposed consisting of bulky light fixtures, bulbs and mounting plates and significantly alter the aesthetic appearance of the cap. It is believed that the altered or odd appearance of such caps having an exposed lighting apparatus is one reason why such caps are not widely worn by the general public.

It is an object of the present invention of providing a cap and light assembly not substantially altering the appearance when compared to caps without light assemblies. In one embodiment the lighting device can be recessed in the bill underside and the power supply can also be recessed in the bill or located in crown area. It is an object of the present invention that, without the light turned on, the cap would appear substantially the same as a cap not having a lighting apparatus. Because the outward appearance of the cap is not significantly changed, it is believed that such caps would receive a better acceptance by the general public.

Another feature found in prior art cap lights is having the flashlight apparatus pointing in a direction generally away from and parallel with the wearer's line of sight, or parallel to the long axis of the bill. Such a configuration is satisfactory for lighting objects in front of the wearer and at a distance, but not good for illuminating objects directly under the wearer's facial area, such as reading a book or performing a task where the work area is very close.

It is an object of the present invention to have the light focused in a generally downward direction from the underside of the bill illuminating objects near the wearer's facial area and below.

It is another object of the invention to satisfy a need for a lighting device for a variety of uses such as safety, emergency, recreation, household uses and work related activities.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. In one embodiment, the cap with light consists of a baseball style or visor style cap and unique light assembly.

In one embodiment, the light assembly can be substantially recessed in the bill, or flush with the underside, so that the aesthetic appearance of the cap is not substantially altered. The batteries can be located in the crown or bill area. In another embodiment, the light assembly can be substantially recessed in a shell and the shell can be attached to the bill.

The reinforcement portion of a typical cap bill consists of molded plastic, paperboard or other similar material. In one embodiment, the bill can be pre-molded with a recess area to fit the circuit board assembly and/or light assembly with light source, reflector and cover. In another embodiment, a wiring channel can be pre-molded in the bill between the light assembly recess and the connection of the bill to the main cap body. In another embodiment, the bill can be thickened in the area immediately surrounding the recessed areas. The thickened section can be gradually tapered to match the surrounding thinner bill material in an inconspicuous manner. Such configuration renders the light assembly substantially unnoticeable until the light is turned on.

In one embodiment, light emitted from a light source remains local to the wearer and focused in a generally downward direction lighting objects near the wearer's facial area and below. This embodiment provides a minimum of disturbance to persons around the wearer and can be generally used as a night light or safety device while walking or jogging.

In a preferred embodiment a cap is fitted with a single light source. In alternative embodiments, multiple lights, light intensities, light assemblies, colors, shapes and other combinations can be used.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
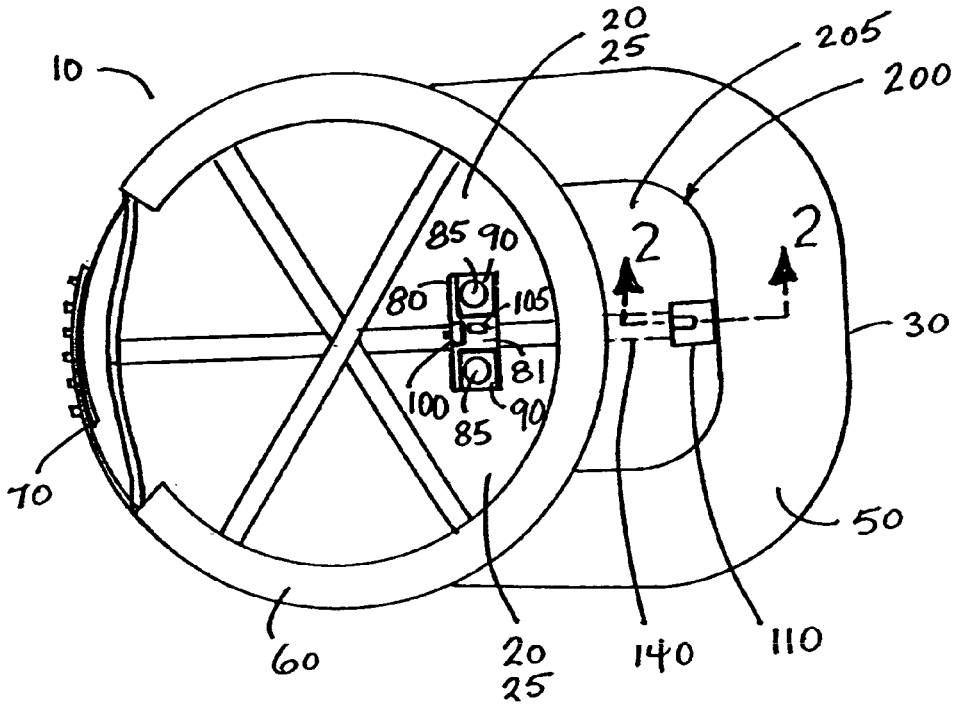
FIG. 1 is bottom view of a baseball style cap with light assembly having batteries located separate from the light assembly.

FIG. 1 is a bottom view of a baseball style cap 10 with light assembly 110. FIG. 1 illustrates the electrical component circuit board assembly with batteries 80 (referred to further herein simply as "battery assembly") located inside the crown area 20 and separate from the light assembly 110. Three main parts of the apparatus can be seen:

(a) light assembly 110, (b) battery assembly 80 mounted inside crown 20, and (c) a formed recessed channel 140 for routing the interconnecting electrical wiring 190 between light assembly 110 and battery assembly 80. Although a baseball type cap 10 is shown, the details of these three components are essentially the same for a visor type cap 300.

Baseball style cap 10 can consist of a fabric hat having a crown 20, a bill 30 extending from the crown 20, a reinforcing crown liner and an inner sweat band 60 extending around the circumference of the bottom of the cap 10. Cap 10 can be a fixed size or include adjustable straps 70.

Figure 6:
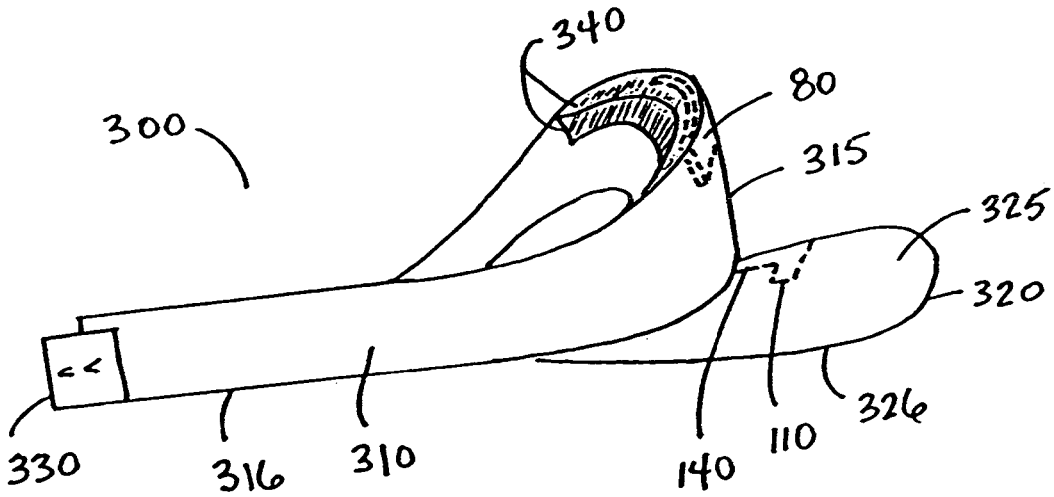
FIG. 6 is a side view of a visor type cap with light assembly.

A typical cap in the golf and tennis sports, commonly referred to as visor 300 (shown in FIG. 6), is similar to baseball style cap 10 except the top fabric of the cap is omitted and the cap consists of bill 320, band 310, and liner 316 extending around the circumference of the cap. Band 315 in the front of the cap can be wider forming a partial crown upon which bill 320 is attached. Cap 300 can be a fixed size or include adjustable straps 330.

Bills 30, 320 can be constructed of an outer fabric covering reinforced with an inner plastic, paperboard or other similar stiffener. Caps 10, 300 can be made in a variety of fabrics, colors and with a variety of embroidered details.

Figure 2:
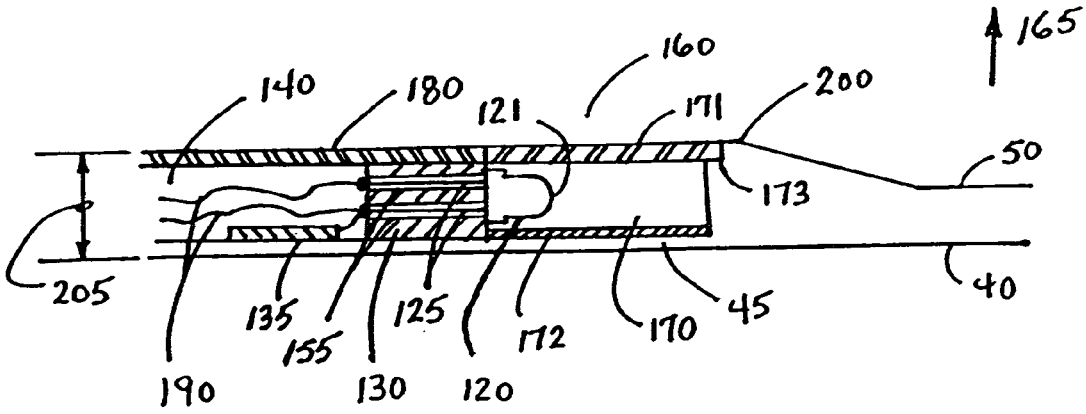
FIG. 2 is a cross section, taken along the lines 2—2 of FIG. 1, through the longitudinal center of the light assembly recess area and the wiring channel showing a completely recessed light assembly.

FIG. 2 is a cross section, taken along the lines 2—2 of FIG. 1 with underside 50 of bill 30 shown at the top of the figure.

Reference numeral 120 is the light source and can be a high intensity white light emitting diode (LED), in a typical T-1 package 3 millimeters (mm) size or T-1¾ package 5 mm size (nominal diameter of light emitting lens section). FIG. 2 shows the light source mounted in a horizontal position (i.e., in-line with the long axis of the bill). These LED's are typically rated approximately between 3 to 6 candelas of luminous intensity respectively and are typically used in high intensity miniature flashlights. They draw approximately 20 milliamps (mA) current at 3.6 Volts (V) to 4.0 V. The LED's are furnished in a T-1 or T-1¾ type configuration and have three distinguishable parts, the light emitting lens section, the base section—to which the light emitting lens section attaches (the base and lens section are integral parts), and two elongated straight metal pin electrical leads 125 emanating from the underside of the base. A typical manufacturer is Nichia America with model numbers NSPW300BS (3 mm) and NSPW500BS (5 mm). There are many other available models and manufacturers of LEDs having similar performance characteristics that will also function in the light assembly.

Light source 120 type can vary. Although a LED light source is preferred due to its durability, low cost, high light intensity, available varieties of colors, sizes and light intensities, etc., any other suitable light source can be used. For instance there are many types of miniature flashlight bulbs small enough but sufficient power to function as required. For example, one bulb is a Radio Shack mini-Krypton Flashlight Lamp, model 272-1150 in a T-1 package with ⅛" lens diameter having an overall size approximately that of the 3-mm size LED. Another light is Radio Shack filament bulb model 272-1149A.

Reference numeral 130 is the receptacle/holder for light source 120. This can be a molded plastic structure with slots 155 for lead pins 125 so that light source 120 can be inserted snuggly. Receptacle/holder 130 can be as long as necessary to fit light source 120 and lead pins 125, and as wide as channel 140. Receptacle/holder 130 may incorporate a heat sink 135 to prevent overheating of light source 120.

Reference numeral 170 is a recess compartment for light source 120 forming light emitting chamber 160 for directing light in the direction of arrow 165. Recess 170 can be preformed in the material of bill 30. The depth of recess 170 is dependent on the size light source 120 used. Recess 170 is shown in a rectangular geometry but other shapes can be equally suitable. Recess 170 can incorporate a thin gauge reflector 172 for concentrating the light in a general downward direction 165. Reflector 172 is preferably used where an LED light source 120 is mounted in a horizontal position or a standard type filament bulb is used. Reflector 172 can be omitted where an LED light source 120 is orientated in a downward direction 165 (shown in FIG. 12). This is because an LED light source 120 includes a directional light beam originating from the end of the lens section 121 and light intensity is focused in a generally downward direction. Alternately, customized LED's can be supplied with a light source producing diode chip located inside the LED at any position (to directionality focus the light beam).

Reflector 172 can be omitted, or the walls of recess 170 can be coated with a reflective material depending on the degree of light concentration and intensity desired from completed light assembly 110.

Reference numeral 171 is a protective optical covering over light assembly 120 and recessed area 170. This can be a clear optical plastic cover similar to those found in typical flashlights. Alternately, a frosted covering can be used to reduce glare, protect against direct eye exposure to bright light, and possibly be more aesthetically pleasing, concealing recess 170 and reflector 172. For heat dissipation it may be necessary to include ventilation holes in optical covering 171 or provide ventilation holes in recess 170. The outward face of covering 171 can be flush or nearly flush with the bottom 50 of bill 30. Covering 171 can be any color, shape or design allowing cap 10 to be used as a novelty item in addition to light source. Alternately, light source 120 can emit a variety of colors of light to produce a similar colored light effect.

Reference numeral 140 is a recessed channel in bill 30. Wiring channel 140 houses electrical wiring 190 routed between battery assembly 80 and light source 120. Recessed channel 140 and recess 170 can be one continuous structure. Reference numeral 180 is a covering installed over wiring channel 140.

Figure 12:
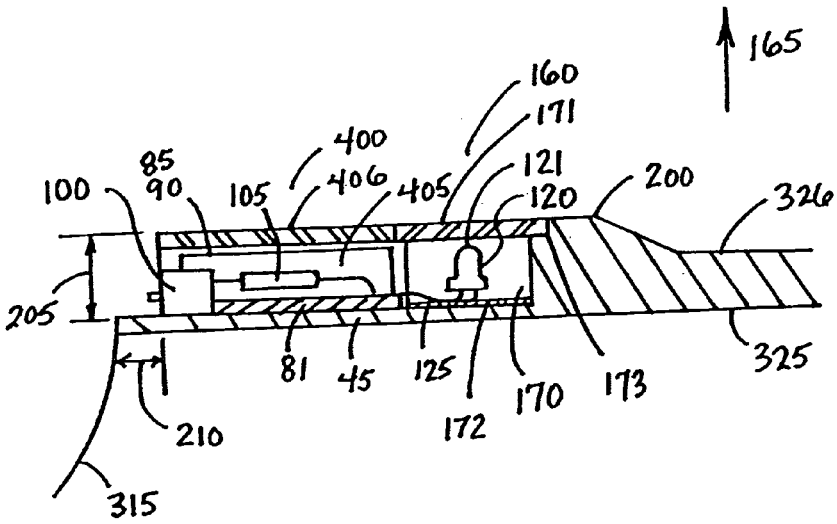
FIG. 12 is a cross section, taken along lines 12—12 of FIG. 10 through the longitudinal center of the light assembly and recess with electric circuit board assembly.

Recess 170 and recessed channel 140 can be preformed into the plastic mold, or other reinforcing material for bill 30. Recess 140 can be narrower than recess area 170. Reflective material 172 can be placed in recess area 170. Light source 120 with receptacle/holder 130 can be fixed at the intersection of the recesses 140, 170 with the top of receptacle/holder 130 being flush with the top of recesses 140, 170. Light source 120 can be mounted in the horizontal position to reduce the required depth of recess 170 (as shown in FIG. 2). Alternately, light source 110 can be mounted in a downward position 165 (as shown in FIG. 12). Electrical wiring 190 can be soldered to lead pins 125 of light source 120. Cover 180 and cover 171 can then be placed over openings 140, 170 and can be flush (or nearly flush) with bottom 50 of bill 30. Fabric covering for bill 30 can be installed so that only covering 171 is visible.

Figure 3:
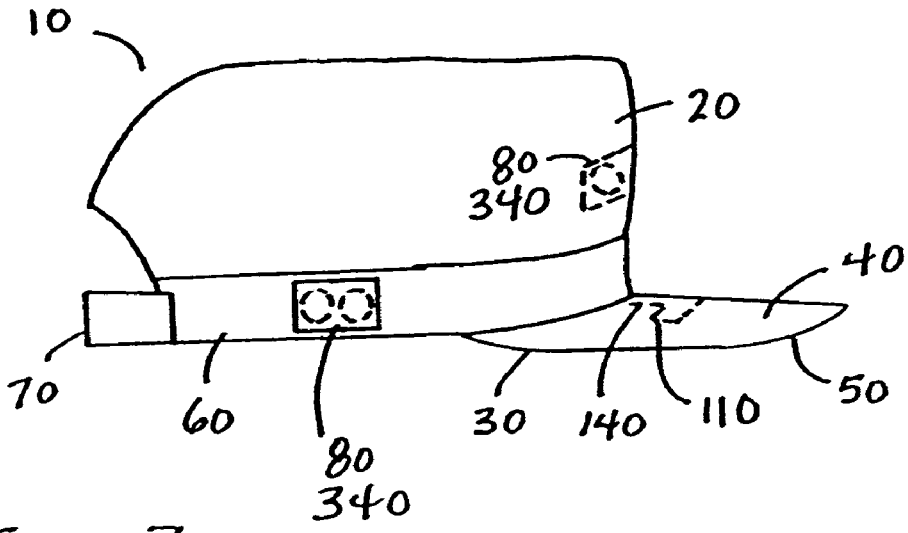
FIG. 3 is a side view of a baseball style cap with light assembly.
Figure 4:
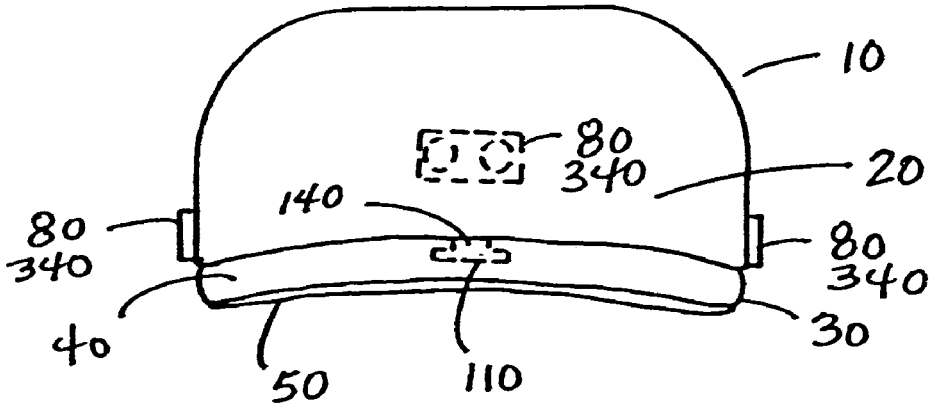
FIG. 4 is a front view of a baseball style cap with light assembly.

The thickness of bill 30 can accommodate light assembly 110 having the resulting installation completely flush (or nearly flush) with bottom 50. At least two options exist: (a) to make entire bill 30 the thickness required to suit light assembly 110 and (b) to make only the area immediately adjacent light assembly 110 thicker. This second option is shown in FIGS. 1 and 2. This thickened area 205 can be made on the underside of bill 30 leaving topside 40 of bill 30 unaltered when compared to a cap without light assembly 110. Reference numeral 200 points to the boundary of thickened section 205. The actual area taken up by thickened section 205 can vary. As shown in FIG. 2, thickened section 205 can be smoothly transitioned to a typical bill thickness for hats on the market, such as approximately ⅛ inches. The resulting thickness of thickened area 205 depends on the size light source 120. Thickened section 205 can be approximately ¼" for 3 mm LEDs mounted in the vertical or horizontal position, and ⅓" thick for 5 mm LEDs mounted in the horizontal position. Bill 30 of a typical cap 10 can be slightly sloped downward from the connection point on the cap crown area 20 to the front edge as illustrated in FIG. 3 helping to hide light assembly 110 when viewing cap 10 from the front. Furthermore, as shown in FIG. 4, bill 30 can be curved from its center to its sides helping to hide light assembly 110 when viewing cap 10 from the sides.

Reference numeral 80 illustrated in FIG. 1 is the battery assembly. In a baseball type cap 10 with a top fabric and complete crown 20, battery assembly 80 can be mounted inside the crown 20 and in the front in reinforced area 25 above sweatband 60. Crown area 20 for caps 10 can be reinforced with a fabric material. In a visor type cap 300 (shown in FIG. 6) without a top material, the assembly 80 can be mounted on the inside of the widened band area 315 at the front of cap 300. Alternately, battery assembly 80 can be located on the outside of cap 10, 300 in the lower sweatband 60, 310 (as shown in FIGS. 3 and 4). An aesthetically pleasing Velcro affixed flap covering 340, or similar covering, can be placed over assembly 80 to conceal it, but allowing access for replacement of batteries 85.

Figure 11:
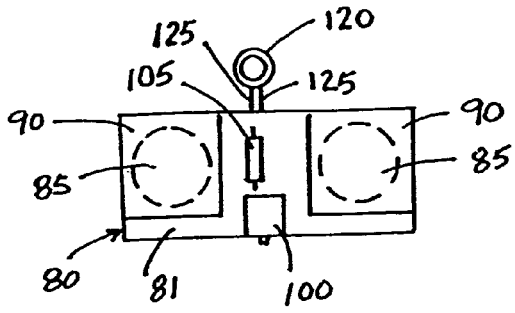
FIG. 11 is a plan view layout of an electric circuit board assembly with batteries.

In one embodiment, shown in FIG. 11, battery assembly 80 can consist of a prefabricated electric circuit board 81 on which is mounted battery holders 90 with batteries 85, circuit switch 100 and resistor 105. Light source 120 can be mounted separately. Assembly 80 can consist of a prefabricated electrical circuit board 81 approximately 1/32" thick, of which numerous types and styles are available from suppliers such as Radio Shack. On circuit board 81 can be mounted all of the electrical components of the circuit via pin and soldered connections. Circuit board 81 can also be furnished as a custom-made printed circuit board (PCB) that can be obtained from numerous manufacturers. In such case, most of the electrical leads between the electrical components can be preprinted and a minimum of soldered connections will be required. Reference numeral 90 is the battery holders with batteries 85. Batteries 85 can be commercially available 3V lithium coin batteries, 20 mm in diameter such a types CR 2016, CR2025, or CR2032. Battery holders 90 can be Keystone Electronics Corporation catalogue number 3003 lithium coin cell battery retainers. These battery holders 90 can be 0.831" long×0.775" wide×0.145" high and made of 0.01" thick phosphor bronze sheet metal. The listed batteries were selected as being easily available, however, many other types of batteries can function equally as well, or even solar cells with an energy storage device. For instance, it can be possible to use three 1.5V type LR 44 button cells connected in series (required to develop the 3.6V minimum LED voltage for a LED light source) or any similar small cells fitting into small areas. There are many other style batteries from various manufacturers that can also function. For example, alkaline type AA or AAA can be used but three connected in series may be required if light source 120 requires 3.6 to 4.0 V, which are not as easily concealed as lithium coin type batteries. Alternately it can be possible to use one AA or one AAA 1.5 V battery with a DC voltage step-up inverter in the electrical circuitry.

Circuit switch 100 can be a miniature on-off slide switch with single-pole-single-throw contacts such as GC Electronics catalogue no. 35-961 or equal which is ⅜" long×¼" wide×3/16" high. Switch 100 can be installed in a notch-out in circuit board 81 so that its bottom is flush with the circuit board 81. In this manner a minimum thickness of circuit board (battery) 80 assembly can be maintained. Other type switches such as on-off pushbutton switchers are equally suitable however these types of switches may not be readily available in miniature sizes. Likewise a miniature momentary pushbutton switch can be used. In this case, the circuit may require a latching mechanism such as a JK flip-flop and transistor combination to form a toggle switch. In such a switching arrangement, the JK flip-flop, transistor, resistors and other components can be supplied on a miniature integrated circuit silicone chip.

Resistor 105 can be of a typical carbon composition. Resistor 105 can be a current and voltage-limiting resistor, in the range between 50 ohms to 300 ohms and ¼ to ½ watt approximately, depending on light source 120 power requirement and battery supply 85. Resistor 105 can limit current and voltage to the LED to the optimum operating requirements and prevents overdriving of the LED. This can also serve to increase the life of light source 120 and batteries 85.

Figure 5:
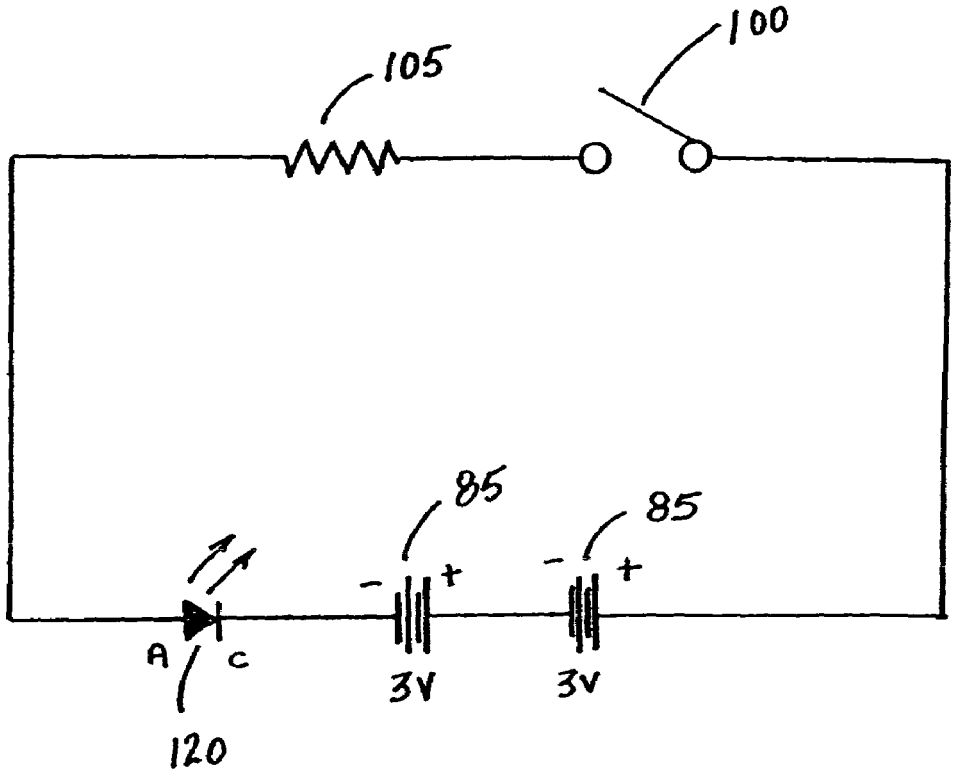
FIG. 5 is an electrical schematic of a lighting circuit.

In FIG. 5 the electrical circuit is shown completed with the components connected in series. Batteries 85 shown in FIG. 5 can be two 3 volt lithium coin batteries connected in series, which is likely the power source if a Nichia type NSPW300 or NSPW500 LED is used for light source 120 requiring 3.6 volt to 4.0 volt at 20 milli-amperes to operate. Resistor 105 size is dependent on the voltage required to be dropped by the resistor so that the resulting voltage and current supplied to light source 120 is within the rated operating voltage and current. For instance, with the 3.6 volt and 20 milli-ampere LED light source 120 operating from a 6 volt power supply (two 3.0 V batteries in series) the required voltage drop by resistor 105 is 2.4 volts at 20 milli-amperes (6.0 volt of source minus 3.6 volt required to the LED). By Ohms law: resistance=voltage/current. Therefore, resistance=2.4 volts/0.02 amps=120 Ohms. Resistor 105 to use in this case would be 120 Ohms.

Figure 7:
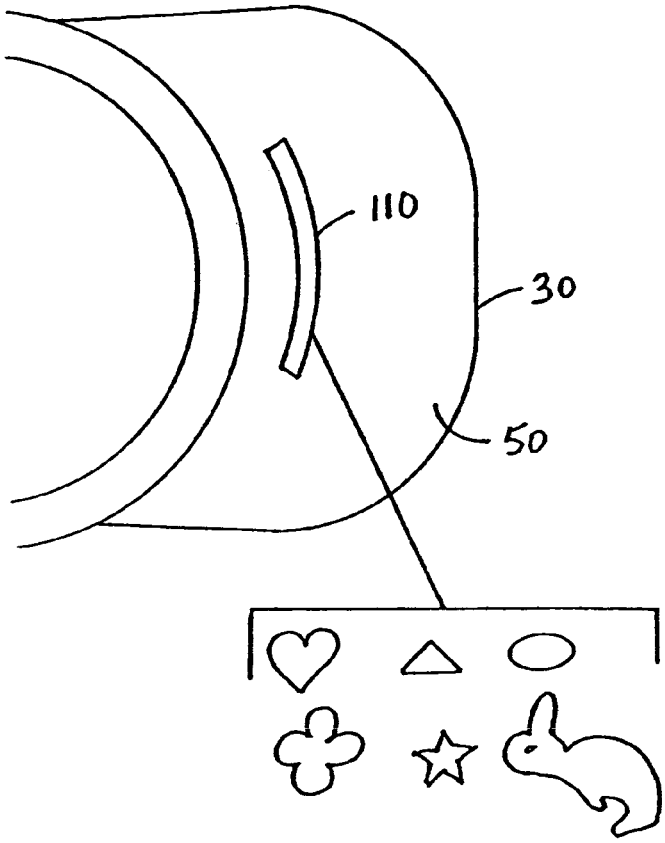
FIG. 7 shows a bill with variously shaped light assemblies.
Figure 8:
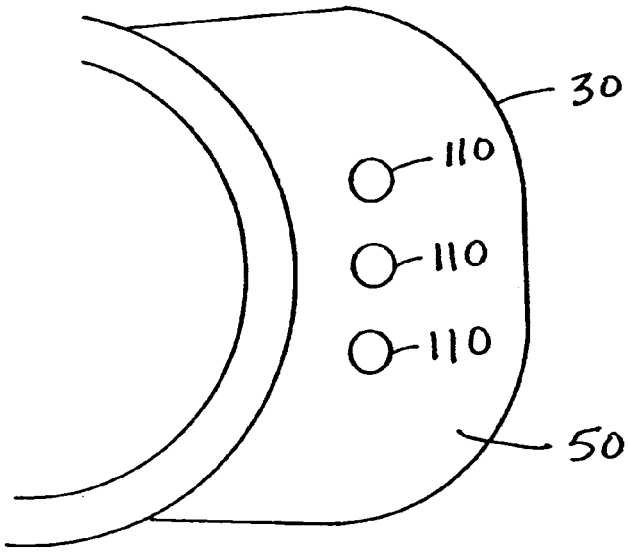
FIG. 8 shows a bill with multiple light assemblies.
Figure 9:
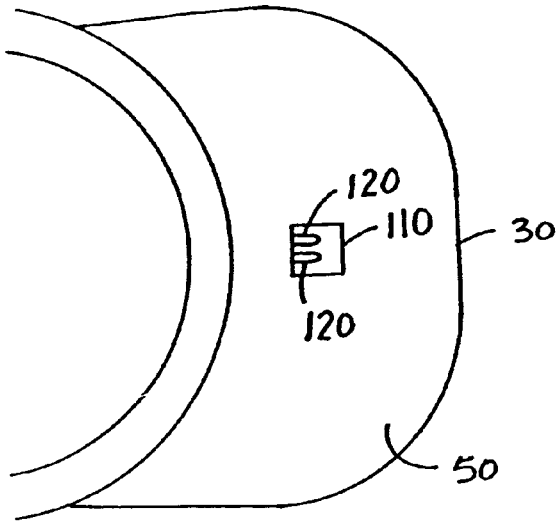
FIG. 9 shows a bill with multiple quantities of lights in a single light assembly.

FIGS. 7 through 9 show various additional alternative embodiments. FIG. 7 shows bill 30 with variously shaped or colored light assemblies 120. The shape of recess 170, light assembly 110, and/or the shape of protective covering 171 may vary. For example, decorative shapes may be used such as shapes of any animate or inanimate object (e.g., for example: heart, star, circle, oval, rabbit, cross, butterfly, flower, etc.). Similarly, the color of covering 171 can vary. Likewise, covering 171 can include a decorative design painted or printed on the surface, or otherwise imprinted into the covering body to enhance its visual appearance. Additionally, covering 171 can be removable and interchangeable with other coverings 171, such as those of similar or different colors, shapes, styles or decorative designs.

FIG. 8 shows a bill 30 with multiple locations for light assemblies 110. Multiple light assemblies 110 can be included in bill 30. The quantity of separate light assemblies 110 can be varied as desired.

FIG. 9 shows a bill 30 with multiple quantities of light sources 120 in the same recess 170. Light assembly 110 may contain multiple light sources such as LEDs in a single recess 170 in bill 30. Light source 120 can vary in intensity, color, size or style package. The intensity of light source 120 can be varied by controlling the supply voltage and current or by varying the quantity of individual light sources 120, such as LED's, turned on for light assemblies 110 using multiple light sources 120. Likewise, circuitry can be provided causing light source 120 to blink periodically, blink at a high frequency, or varying intensities producing a strobe effect.

Figure 10:
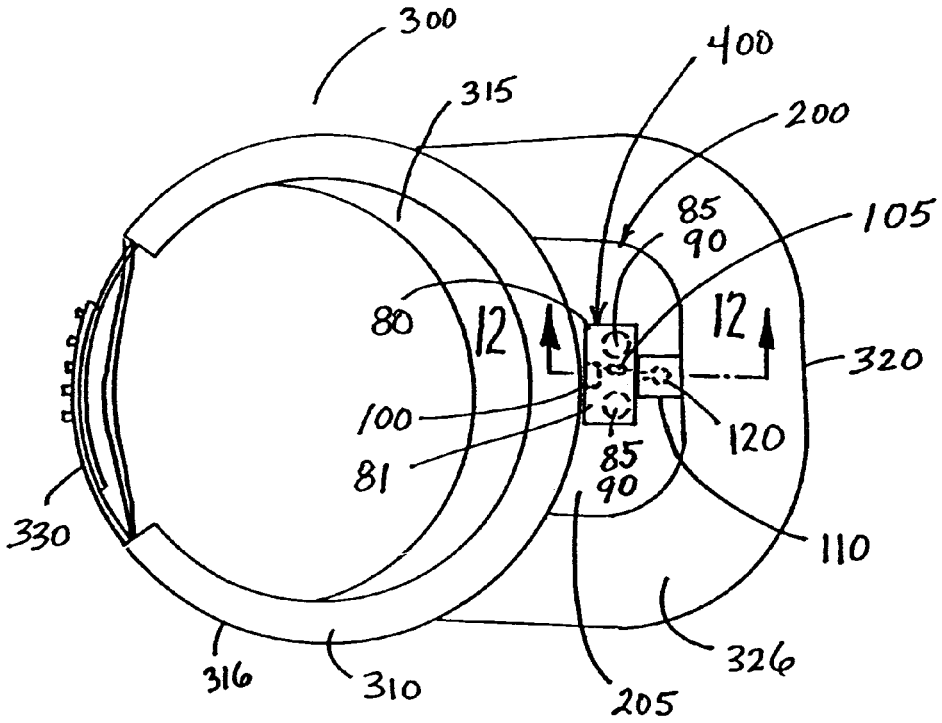
FIG. 10 is a bottom view of a visor type cap with the light assembly where the electric circuit board assembly with batteries is recessed in the bill underside adjacent to the light assembly.

FIG. 10 shows a view of the underside of cap 300 where battery assembly 80 is installed adjacent to light assembly 110 in recess 400 on underside 326 of bill 320. FIG. 11 is a layout of battery assembly 80 shown in FIG. 10. In this embodiment, light source 120 can be attached directly to battery assembly 80. Thickened section 205 of bill 320 can be approximately ¼" thick or less for a T-1 (3 mm) LED (with the LED mounted in a downward 165 or horizontal position) and ⅓' thick or less for the T-1¾ (5 mm) LED (with the LED mounted in the horizontal position). The dimensions of the battery assembly 80 can be 2⅛0" long×1" wide×3/16" high. Dimensions of the battery holder 90 can be 0.775 inches by 0.831 inches. The entire apparatus can be situated towards the rear of the bill as shown in FIG. 10.

FIG. 12 is a cross section, taken along the lines of 12—12 of FIG. 10 with the underside 326 of bill 320 shown at the top of the figure. Recess 170 houses light source 120 and can include a covering 171 and a reflector 172. Recess 405 of compartment 400 houses battery assembly 80. Recess 170 and recess 405 can be one continuous structure without boundary, although they can be of different shapes and sizes. Covering 406 over battery assembly 80 can be removable for battery replacement. Although light source 120 is attached to battery assembly 80 that is affixed in recess 405, the light emitting section of light source 120 can extend into recess 170 via the elongated electrode pins 125. Light source 120 can be mounted vertically or horizontally in recess 170. Light source 120 is shown mounted vertically in the direction of arrow 165 with light-emitting lens section end 121 pointing down. Reflector 172 is optional. The underside 326 of bill 320 can be thickened to suit the space for the components as previously described. The thickened section can be terminated at point 210 short of the sweatband and crown to prevent discomfort to the wearer.

Where the battery assembly 80 is located adjacent to the light assembly 110 recess 170 and recess 405 can be preformed into a plastic mold, or other material which comprises the reinforcement material of bill 320. The mold can be made such that approximately 1/32" of bill reinforcement material 45 can remain at the bottom of recess 170, 405 to form a backing between the bottom of battery assembly 80 and a typical fabric covering placed on topside 325. The mold can be thickened to thickness 205 for flush mounting of light assembly 110 and finished battery assembly compartment 400. Reveals 173 can secure covers 171, 406. The typical bill cloth covering can be installed up to the edges of the recesses 170, 405 by sewing to the bill material. All of the preceding can be performed by a manufacturer of the caps, considering that the caps can be obtained in a mass production process. Battery assembly 80 can be pre-manufactured by an electrical component manufacturer. Reflector material 172 can be placed in recess 170 and secured with a suitable adhesive. Battery assembly 80, with light source 120 attached, can be placed into recesses 170, 405 and secured with a suitable adhesive or attachments. Optical covering 171 can be placed over recess 170 and removable covering 406 can be placed over recess 405. The removable covering 406 can be pre-covered independently with the matching fabric of the bill material with a suitable fabric glue. It can be possible that only light covering 171 will be visible in the final product.

Alternately, where battery assembly 80 is located adjacent to light assembly 110. The entire apparatus can be fabricated as an integral package. The assembly can be placed into bill 320 as a single unit in recesses 170, 405 and secured with a suitable adhesive or attachments. This type of configuration is suitable for mass production situations. In this case the cap 300 can be furnished by a cap manufacturer with recesses 170, 405 and bill cloth fabric installed up to the recesses 170, 405. The electronics manufacture can fabricate the entire assembly with a removable cover 406 over the circuit board area for changing batteries 85 which has a matching piece of cloth covering cover 406. All that would then be required is to put the two pieces (cap and packaged integral light assembly) together during final assembly and packaging process.

In another alternative embodiment light assembly 110, switch 100, and battery assembly 80 can be substantially or completely recessed in a pre-molded shell 410. Shell 410 can be fabricated so that it substantially follows the curvature of bill 30, 320. In this embodiment shell 410 and all electrical components can be manufactured independent of any cap and can be subsequently attached to a standard cap.

Figure 13:
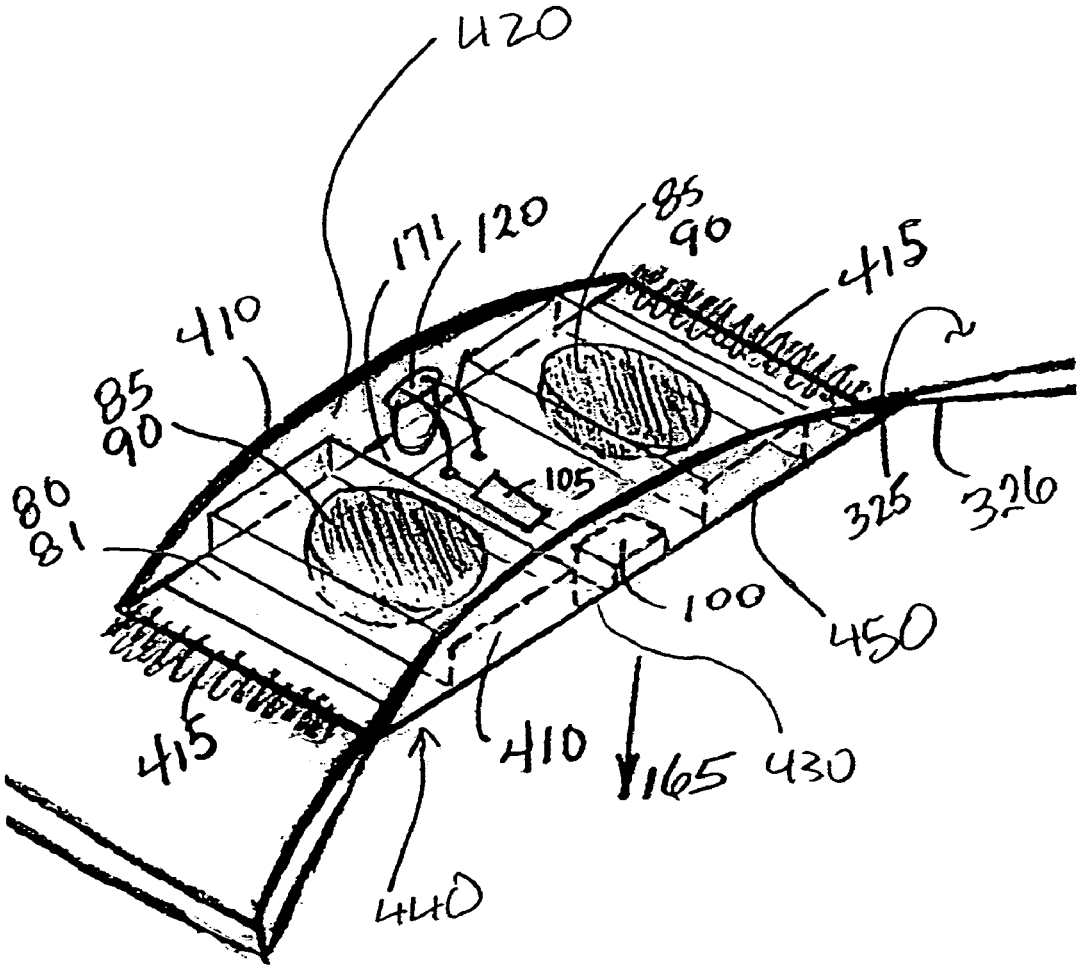
FIG. 13 is a perspective view of a shell or housing embodiment showing the components of a light assembly housed or substantially recessed in the shell or housing.

FIG. 13 shows a perspective view of a shell or housing 410 including light assembly 110 housed or substantially recessed in shell or housing 410. Light assembly 110 is shown comprising light source 120 and covering 171 for light assembly 110, which can be translucent; batteries 85 and battery holders 90, circuit switch 100 and resistor 105 on prefabricated circuit board 81. Pre-molded shell or housing 410 is attached to bottom 326 of bill 320. Light produced by light source 120 is directed in a generally downward direction 165 from bottom 326 of bill 320. Top of bill 320 is indicated by reference number 325.

In this embodiment all components can be substantially or completely recessed within pre-molded shell or housing 410. Shell or housing 410 can contain light and battery assemblies 110, 80 such that all components are concealed, excepting translucent covering 171 for light source 120. Shell 410 can be fabricated so that it substantially follows the curvature of bottom 326 of bill 320. Top side 420 of shell can be curved to conform to the curvature of bottom 326.

In one embodiment shell 410 and light assembly 110 can be manufactured separately from cap 10 or visor 300. Shell or housing 410 and all components can be manufactured independent of any cap 10 or visor 300.

Shell 410 can be of various shapes, sizes, and configurations. Shell 410 does not have to conform to the contour of bottom 326 of bill 320. In one embodiment shell 410 can be of monolithic shape. In another embodiment shell 410 can be less than that size of a quarter.

Shell or housing 410 can be a single unit and removably or permanently attached to a conventional cap 10 or visor 300. Permanently attached is defined as removal causing substantial damage to one or more components of either shell 410 and/or bill 320. It is possible that no substantial modifications to standard cap 10 or visor 300 will be required for attachment of shell 410. The method for attaching shell 410 to bottom of bill 326 can vary, including but not limited to adhesive 415, mechanical fasteners, velcro, or other fastening means. The fastening means can be permanent or removable. For example, shell 410 can include velcro fasteners 415 pre-attached to shell 410. In one embodiment, the mating velcro for velcro fastener 415 can be included with shell 410 for attachment to bottom 326 of bill 320 on a standard cap 10 or visor 300 and sold as a single unit.

Shell 410 can have one or more removable covers or doors 450 on either its top 420 or bottom 430 sides, such as to facilitate replacement of batteries 85. These doors can be attached through a variety of means, such as snap connected to shell 410 or pivotally connected.

A shell covering 440 can conceal bottom 430 of shell 410, or shell 410 can remain exposed after connection to cap 10 or visor 300. It is preferred that, after installation on cap 10 or visor 300, a removable shell covering 440 substantially conceals bottom 430 of shell 410. Such shell covering 440 can be opened for access to shell 410. It is also preferred that a removable shell door 450 be included in shell for access to shell components, such as when replacing batteries 85. In one embodiment shell 410 can be completely detached from bottom 326 of bill 320 for access to and/or replacement of one or more shell components.

Various alternate embodiments exist which can produce an apparatus having substantially the same external appearance of the embodiments previously described and shown in FIG. 1, FIG. 10 and FIG. 13.

In one alternate embodiment for cap 10 shown in FIG. 1 or visor 300 shown in FIG. 10, channel/recesses 140, 170, 405 can be molded or shaped into a separate material 500 independent of bills 30, 320. Such construction could be instead of molding channel/recesses 140, 170, 405 directly into bills 30, 320. Separate material 500 can be shaped to conform to bottoms 50, 326 and can be substantially flexible or substantially rigid or a combination thereof. For example material 500 can be constructed of plastic, foam, foam rubber, or other construction. Material 500 can then be attached to bottom 50, 326 to form the thickened area of the bill 205 with boundary 200 and recesses 140, 170, 405. Battery and light assemblies 80, 110 can be placed in channel/recesses 140, 170, 405 and coverings 171, 180, 406 can be placed over the assemblies 80, 110. Coverings 171, 180, 406 can be flush with the surface of material 500. Similar to thickened area 205, material 500 can be gradually tapered to meet bills 30, 320. A covering 510 can be placed over material 500 concealing battery and light assemblies 80,110, but allowing light from light assembly 110 to pass through.

Alternatively, covering 510 can be used to both hold and conceal light assembly 110. In this embodiment, light assembly 110 is not required to be directly connected to bills 30,320, but can be held by covering 510. Covering 510 can be constructed of various conventionally available materials, such as fabric, cloth, plastic, rubber, etc. Covering 510 is preferably constructed so that light from light assembly 110 can pass through. An opening 515 in covering can be made for light to pass through or covering can be constructed at least partially of a material which allows light to pass through.

In an alternate construction method of cap 300 shown in FIG. 13, instead of attaching battery and light assemblies 80, 110 to shell 410; assemblies 80, 110 can be fastened to the bottom 326 of bill 320. Shell 410 having substantially the same attributes and components as previously described can also be attached to bill 320 substantially concealing and protecting assemblies 80, 110. Shell 410 can form a surface for attaching the covering 440 or door 450. Covering 440 can also be used to substantially conceal shell. Covering 440 can be constructed of any conventionally available material, such as plastic, cloth, rubber, etc. Covering 440 can also be part of fabric covering for bill 320.

The following is a list of reference numerals:

LIST FOR REFERENCE NUMERALS

| (Part No.) | (Description) |
|---|---|
| 10 | baseball cap |
| 20 | crown |
| 25 | reinforced area |
| 30 | bill |
| 40 | top of bill |
| 45 | remaining bill material after recesses are preformed |
| 50 | bottom of bill |
| 60 | sweatband or liner |
| 70 | adjustable strap |
| 80 | battery assembly |
| 81 | prefabricated circuit board |
| 85 | battery |
| 90 | battery holder |
| 100 | circuit switch |
| 105 | circuit resistor |
| 110 | light assembly |
| 120 | light source |
| 130 | end of LED type light source lens |
| 125 | electrode lead pins of light source |
| 130 | receptacle/holder |
| 135 | heat sink |
| 140 | wiring channel |

-continued

LIST FOR REFERENCE NUMERALS

| (Part No.) | (Description) |
|---|---|
| 155 | slots in receptacle/holder |
| 160 | light emitting chamber |
| 165 | arrow pointing downward form the underside of the bill |
| 170 | recess for light assembly |
| 171 | covering for light assembly |
| 172 | reflector for light assembly |
| 173 | reveal in the bill around border of recesses for inserting coverings |
| 180 | cover to recessed wiring chamber |
| 190 | electrical lead wires |
| 200 | boundary of thickened section of bill underside |
| 205 | thickened area of bill underside |
| 210 | point |
| 300 | visor cap |
| 310 | band |
| 315 | widened band area |
| 316 | liner |
| 320 | bill |
| 325 | top of bill |
| 326 | bottom of bill |
| 330 | adjustable strap |
| 340 | covering |
| 400 | recess compartment in bill underside for housing battery assembly |
| 405 | recess |
| 406 | covering over recess |
| 410 | shell |
| 415 | fastener means (e.g., adhesive, velcro, rivet, screw) |
| 420 | top of shell |
| 430 | bottom of shell |
| 440 | covering for shell |
| 450 | shell door |
| 500 | material |
| 510 | covering |
| 515 | opening |

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

What is claimed is:

1. A cap comprising:

(a) a bill having top and bottom side, (b) a light assembly attached to the bill through the bottom side, the light assembly having a light source, (c) wherein the light assembly is at least substantially recessed in the bill through the bottom side, (d) a battery assembly powering the light source, and (e) a switch electrically connected to the battery assembly and the light source.

2. The cap of claim 1, wherein the light source comprises a light emitting diode.

3. The cap of claim 1, wherein the light assembly is completely recessed in the bill.

4. The cap of claim 1, further comprising a crown portion, the crown portion being connected to the bill, the battery assembly being installed in the crown portion.

5. The cap of claim 1, further comprising a cover, the cover being placed over the light source.

6. The cap of claim 5, wherein the cover is replaceable with covers selected from a set of a plurality of different colored covers.

7. The cap of claim 5, wherein the cover is replaceable with covers selected from a set of a plurality of covers having different decorative designs.

8. The cap of claim 7, wherein the plurality of covers having decorative designs at least include a heart, star, circle, parallelogram, polygon, moon, animal, plant, and vehicle.

9. The cap of claim 1, further comprising a reflector, the reflector being placed in the light assembly and at least partially reflecting light from the light source.

10. The cap of claim 1, further comprising:

(a) a channel located in the bill and adjacent the light assembly, the channel including a cover placed over the channel, (b) a plurality of wires connecting the light assembly and the battery assembly, (c) the plurality of wires being at least partially contained in the channel.

11. The cap of claim 1, further comprising a light source control, the light source control allowing a strobe effect to be created from the light source.

12. The cap of claim 11, wherein the light source control can vary both the intensity and frequency of the strobe effect created by the light source.

13. The cap of claim 1, wherein the bill is of a substantially uniform thickness.

14. The cap of claim 1, further comprising a cover concealing the battery assembly.

15. The cap of claim 2, further comprising a heat sink located adjacent the light emitting diode.

16. The cap of claim 1, further comprising a second light assembly at least substantially recessed in the bill, the second light assembly being controllable independent from the first light assembly.

17. The cap of claim 1, wherein the cap is a visor style cap.

18. The cap of claim 1, wherein the bill includes a thickened portion wherein the light assembly is substantially recessed, the thickened portion having at least tapered portion.

19. The cap of claim 1, wherein the light assembly comprises a plurality of light sources, at least one of the light sources being separably controllable from at least one of the other light sources.

20. The cap of claim 19, wherein at least one of the light sources emitting a different color of light from at least one of the other light sources.

21. The cap of claim 2, further comprising a resistor operatively connected to the light assembly.

22. The cap of claim 1, further comprising a cover attached to the bottom of the bill, the cover substantially concealing at least the light assembly while allowing light to be emitted from the light source.

23. The cap of claim 1, wherein the battery assembly is attached to the bill in close proximity to the light assembly.

24. A cap comprising:

(a) a bill having top and bottom side, (b) a light assembly attached to the bill on the bottom side, the light assembly having a light source fixed in a single position, (c) wherein light emitted from the light source is substantially directed in a direction perpendicular to the bill on the bottom side, (d) a battery assembly powering the light source, and
(e) a switch electrically connected to the battery assembly and the light source.

25. The cap of claim 24, wherein the light source comprises a light emitting diode.

26. The cap of claim 24, wherein the light assembly is substantially recessed in the bill.

27. The cap of claim 24, further comprising a crown portion, the crown portion being connected to the bill, the battery assembly being installed in the crown portion.

28. The cap of claim 24, further comprising a cover, the cover being placed over the light source.

29. The cap of claim 28, wherein the cover is replaceable with covers selected from a set of a plurality of different colored covers.

30. The cap of claim 28, wherein the cover is replaceable with covers selected from a set of a plurality of covers having different decorative designs.

31. The cap of claim 30, wherein the plurality of covers having decorative designs at least include a heart, star, circle, parallelogram, polygon, moon, animal, plant, and vehicle.

32. The cap of claim 24, further comprising a reflector, the reflector being placed in the light assembly and at least partially reflecting light from the light source.

33. The cap of claim 24, further comprising:
(a) a channel located in the bill and adjacent the light assembly, the channel including a cover placed over the channel,
(b) a plurality of wires connecting the light assembly and the battery assembly,
(c) the plurality of wires being at least partially contained in the channel.

34. The cap of claim 24, further comprising a light source control, the light source control allowing a strobe effect to be created from the light source.

35. The cap of claim 34, wherein the light source control can vary both the intensity and frequency of the strobe effect created by the light source.

36. The cap of claim 24, wherein the bill is of a substantially uniform thickness.

37. The cap of claim 24, further comprising a cover concealing the battery assembly.

38. The cap of claim 25, further comprising a heat sink located adjacent the light emitting diode.

39. The cap of claim 24, further comprising a second light assembly, the second light assembly comprising a second light source, wherein light emitted from the second light source being substantially directed in a direction perpendicular to the bill on the bottom side, the second light assembly being controllable independent from the first light assembly.

40. The cap of claim 24, wherein the cap is a visor style cap.

41. The cap of claim 24, wherein the bill includes a thickened portion wherein the light assembly is substantially recessed, the thickened portion having at least tapered portion.

42. The cap of claim 24, further comprising a shell, the shell housing the light assembly, battery assembly, and switch.

43. The cap of claim 42, wherein the shell has a shape which substantially conforms to the shape of the bottom side of the bill.

44. The cap of claim 24, further comprising a cover attached to the bottom side of the bill, the cover substantially concealing at least the light assembly while allowing light to be emitted from the light source.

45. The cap of claim 24, wherein the light assembly comprises a plurality of light sources, at least one of the light sources being separably controllable from at least one of the other light sources.

46. The cap of claim 45, wherein at least one of the light sources emitting a different color of light from at least one of the other light sources.

47. The cap of claim 25, further comprising a resistor operatively connected to the light assembly.

48. The cap of claim 24, wherein the battery assembly is attached to the bill in close proximity to the light assembly.

49. A cap comprising:
(a) a bill having top and bottom side,
(b) a light assembly located under the bill, the light assembly having a light source,
(c) a cover, the cover substantially concealing at least the light assembly while allowing light to be emitted from the light source,
(d) a battery assembly powering the light source,
(e) a switch electrically connected to the battery assembly and the light source, and
(f) further comprising a shell housing, the shell housing containing the light assembly battery assembly and switch, the shell housing being permanently attached to the bottom side of the bill.

50. The cap of claim 49, wherein the light source comprises a light emitting diode.

51. The cap of claim 49, further comprising a second light assembly including a second light source, the cover also substantially concealing the second light assembly while allowing light to be emitted from the second light source, the second light source being controllable independent from the first light source.

52. The cap of claim 49, the bill having a cover on its top side, wherein the cover attached to the bottom of the bill substantially matches in appearance the cover on the top side.

53. The cap of claim 49, wherein the light assembly is substantially recessed in the bill.

54. The cap of claim 49, further comprising a crown portion, the crown portion being connected to the bill, the battery assembly being installed in the crown portion.

55. The cap of claim 49, further comprising an optical cover, the optical cover being placed over the light source.

56. The cap of claim 55, wherein the optical cover is replaceable with other optical covers selected from a set of a plurality of different colored optical covers.

57. The cap of claim 55, wherein the optical cover is replaceable with other optical covers selected from a set of a plurality of optical covers having different decorative designs.

58. The cap of claim 57, wherein the plurality of optical covers having different designs at least include a heart, star, circle, parallelogram, polygon, moon, animal, plant, and vehicle.

59. The cap of claim 49, further comprising a reflector, the reflector being placed in the light assembly and at least partially reflecting light from the light source.

60. The cap of claim 49, further comprising:
(a) a channel located in the bill and adjacent the light assembly, the channel including a top placed over the channel,
(b) a plurality of wires connecting the light assembly and the battery assembly,
(c) the plurality of wires being at least partially contained in the channel.

61. The cap of claim 49, further comprising a light source control, the light source control allowing a strobe effect to be created from the light source.

62. The cap of claim 61, wherein the light source control can vary both the intensity and frequency of the strobe effect created by the light source.

63. The cap of claim 49, wherein the bill is of a substantially uniform thickness.

64. The cap of claim 54, further comprising a flap for hiding the battery assembly.

65. The cap of claim 50, further comprising a heat sink located adjacent the light emitting diode.

66. The cap of claim 49, wherein the cap is a visor style cap.

67. The cap of claim 49, wherein the light assembly comprises a plurality of light sources, at least one of the light sources being separably controllable from at least one of the other light sources.

68. The cap of claim 67, wherein at least one of the light sources emitting a different color of light from at least one of the other light sources.

69. The cap of claim 49, wherein the battery assembly is attached to the bill in close proximity to the light assembly.

70. The cap in claim 69, further comprising a battery cover, the battery cover concealing the battery assembly.

71. The cap in claim 49, wherein the bill includes a thickened portion wherein the light assembly is substantially recessed, the thickened portion having at least a tapered portion.

72. The cap of claim 49, wherein the light assembly is completely recessed in the bill.

73. The cap in claim 49, wherein the light emitted from the light source is directed in a direction substantially perpendicular to the bill.

74. The cap of claim 70, wherein the battery cover is removable for replacement of the batteries.

75. The cap of claim 49, further comprising a shell housing, the shell housing containing the light assembly, battery assembly, and switch, the shell housing being removably attached to the bottom side of the bill.

76. The cap of claim 75, wherein the shell housing has a shape substantially conforming to the bill.

77. The cap of claim 75, wherein the shell housing is attached using velcro.

78. The cap of claim 75, wherein a majority of the shell housing is exposed.

79. The cap of 75, further comprising a battery door, the battery door at least partially enclosing the batteries.

80. The cap of claim 49, wherein the cover conforms substantially to the shape of the bottom side of the bill.

81. The cap of claim 49, wherein the cover is orientated in a plane that is substantially parallel with the underside of the bill.

82. The cap of claim 49, wherein the cover is comprised of a fabric visually similar to the top side of the bill.

83. The cap of claim 49, wherein the light assembly is located substantially in the center of the bill along the bill's longitudinal axis.

84. The cap of claim 49, further comprising a main body, the main body being attached to the bill, wherein the light assembly is located substantially adjacent to the connection between the main body and the bill.

85. The cap in claim 69, wherein the battery assembly is substantially recessed in the bill.

86. The cap of claim 69, wherein the battery assembly is completely recessed in the bill.

87. The cap of claim 69, wherein the battery assembly is removably attached to the bill.

88. The cap of claim 18, wherein the light assembly is completely recessed.

89. The cap of claim 1, wherein the light emitted from the light source is directed in a direction substantially perpendicular to the bill.

90. The cap of claim 23, further comprising a cover substantially concealing the battery assembly.

91. The cap of claim 90, wherein the cover is removably attached to the bill.

92. The cap of claim 22, wherein the cover substantially conforms to the bottom side of the bill.

93. The cap of claim 22, wherein the cover is substantially flat.

94. The cap of claim 22, wherein the cover appears visually similar to the top side of the bill.

95. The cap of claim 1, wherein the light assembly is located substantially in the center of the bill along its longitudinal axis.

96. The cap of claim 4, wherein the light assembly is located substantially proximate to the connection between the crown and the bill.

97. The cap of claim 23, wherein the battery assembly is substantially recessed in the bill.

98. The cap of claim 23, wherein the battery assembly is completely recessed in the bill.

99. The cap of claim 24, wherein the light assembly is completely recessed in the bill.

100. The cap of claim 42, wherein the shell is permanently attached to the bottom side of the bill.

101. The cap of claim 42, further comprising a cover, the cover being attached to the shell and substantially concealing the light assembly, battery assembly and switch, the cover being substantially translucent to light emitted from the light source.

102. The cap of claim 42, wherein the shell is removably attached to the bottom side of the bill.

103. The cap in claim 102 wherein the shell is removably attached using velcro fasteners.

104. The cap of claim 42, wherein a majority of the shell housing is exposed.

105. The cap of claim 102, further comprising a battery door, the battery door being removably connected to the shell.

106. The cap in claim 48, further comprising a battery cover, the battery cover at least partially enclosing the batteries.

107. The cap of claim 44, wherein the cover has a shape substantially conforming to the bottom of the bill.

108. The cap of claim 44, wherein the cover is substantially flat.

109. The cap of claim 44, wherein the cover comprises a fabric appearing visually similar to the top side of the bill.

110. The cap in claim 24, wherein the light assembly is located at the center of the bill along its longitudinal axis.

111. The cap in claim 24, further comprising a main body, the main body being attached to the bill, wherein the light assembly is located substantially adjacent to the connection between the main body and the bill.

112. The cap in claim 48, wherein the battery assembly is substantially recessed in the bill.

113. The cap of claim 48, wherein the battery assembly is completely recessed in the bill.

114. The cap of claim 1, wherein the battery assembly is located in the cap main body in the lower band area either on the inside or outside of the cap.

115. The cap of claim 2, wherein the battery assembly includes a DC voltage inverter to step up the DC voltage to permit the operation of an LED light source with a single 1.5 volt battery.

116. The cap of claim 49, wherein cover is substantially flat.

117. The cap of claim 22, wherein the cover is orientated in a plane that is substantially parallel with the underside of the bill.

118. The cap of claim 44, wherein the cover is orientated in a plane that is substantially parallel with the underside of the bill.

119. The cap of claim 49 further comprising a resistor operatively connected to the light assembly.

120. The cap in claim 75, further comprising a battery cover, the battery cover concealing the battery assembly.

121. The cap in claim 49, further comprising a battery cover, the battery cover concealing the battery assembly.

122. The cap of claim 71, wherein the light assembly is completely recessed in the bill.

123. The cap of claim 120, wherein the battery cover is removable for replacement of the batteries.

124. The cap of claim 121, wherein the battery cover is removable for replacement of the batteries.

125. The cap of claim 69, further comprising a shell housing, the shell housing containing the light assembly, battery assembly, and switch, the shell housing being removably attached to the bottom side of the bill.

126. The cap of claim 69, further comprising a shell housing, the shell housing containing the light assembly, battery assembly, and switch, the shell housing being permanently attached to the bottom side of the bill.

127. The cap of claim 70, wherein the cover conforms substantially to the shape of the bottom side of the bill.

128. The cap of claim 70, wherein the covering is orientated in a plane that is substantially parallel with the underside of the bill.

129. The cap of claim 70, wherein the cover is comprised of a fabric visually similar to the top side of the bill.

130. The cap of claim 90, wherein the cover substantially conforms to the bottom side of the bill.

131. The cap of claim 90, wherein the cover is substantially flat.

132. The cap of claim 90, wherein the cover appears visually similar to the top side of the bill.

133. The cap of claim 41, wherein the light assembly is completely recessed in the bill.

134. The cap in claim 101, further comprising a battery cover, the battery cover at least partially enclosing the batteries.

135. The cap of claim 101, wherein the cover has a shape substantially conforming to the bottom of the bill.

136. The cap of claim 101, wherein the cover is substantially flat.

137. The cap of claim 101, wherein the cover comprises a fabric appearing visually similar to the top side of the bill.

138. The cap in claim 42, wherein the light assembly is located at the center of the bill along its longitudinal axis.

139. The cap in claim 42, further comprising a main body, the main body being attached to the bill, wherein the light assembly is located substantially adjacent to the connection between the main body and the bill.

140. The cap of claim 24, wherein the battery assembly is located in the cap main body in the lower band area either on the inside or outside of the cap.

141. The cap of claim 84, wherein the battery assembly is located in the cap main body in the lower band area either on the inside or outside of the cap.

142. The cap of claim 25, wherein the battery assembly includes a DC voltage inverter to step up the DC voltage to permit the operation of an LED light source with a single 1.5 volt battery.

143. The cap of claim 50, wherein the battery assembly includes a DC voltage inverter to step up the DC voltage to permit the operation of an LED light source with a single 1.5 volt battery.

144. The cap of claim 70 wherein the cover is substantially flat.

145. The cap of claim 90 wherein the cover is orientated in a plane that is substantially parallel with the underside of the bill.

146. The cap of claim 101, wherein the cover is orientated in a plane that is substantially parallel with the underside of the bill.

* * * * *